US009644826B2

(12) United States Patent
Moore

(10) Patent No.: US 9,644,826 B2
(45) Date of Patent: May 9, 2017

(54) WEAPON WITH REDIRECTED LIGHTING BEAM

(71) Applicant: Larry E. Moore, Cottonwood, AZ (US)

(72) Inventor: Larry E. Moore, Cottonwood, AZ (US)

( * ) Notice: Subject to any disclaimer, the term of this patent is extended or adjusted under 35 U.S.C. 154(b) by 205 days.

(21) Appl. No.: 14/630,467

(22) Filed: Feb. 24, 2015

(65) Prior Publication Data

US 2015/0308670 A1 Oct. 29, 2015

Related U.S. Application Data

(60) Provisional application No. 61/984,655, filed on Apr. 25, 2014.

(51) Int. Cl.

| | |
|---|---|
| ***F21V 23/04*** | (2006.01) |
| ***F21V 21/40*** | (2006.01) |
| ***F21V 7/00*** | (2006.01) |
| ***F21V 23/02*** | (2006.01) |
| ***F41G 1/36*** | (2006.01) |
| ***F41G 1/35*** | (2006.01) |

(52) U.S. Cl.

CPC ..... *F21V 23/04* (2013.01); *F21V 7/00* (2013.01); *F21V 21/40* (2013.01); *F21V 23/023* (2013.01); *F41G 1/35* (2013.01); *F41G 1/36* (2013.01)

(58) Field of Classification Search

CPC . F21V 23/04; F21V 21/40; F21V 7/00; F41G 1/35; F41G 1/36

See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Zinsser |
| 2,904,888 | A | 9/1959 | Niesp |
| 3,112,567 | A | 12/1963 | Flanagan |
| 3,284,905 | A | 3/1964 | Simmons |
| 3,192,915 | A | 7/1965 | Norris et al. |
| 3,510,965 | A | 5/1970 | Rhea |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

USPTO; Notice of Allowance dated Jul. 7, 2015 in U.S. Appl. No. 14/182,140.

(Continued)

*Primary Examiner* — David V Bruce
(74) *Attorney, Agent, or Firm* — Snell & Wilmer LLP

(57) ABSTRACT

A lighting device for a gun, which is preferably a small revolver having a total length of less than 6", is positioned in a grip (or handle portion) of the gun and includes a mirror to redirect the light beam along the side or top of the gun and preferably parallel to the axis of the gun barrel.

26 Claims, 9 Drawing Sheets

(56) References Cited

U.S. PATENT DOCUMENTS

| | | | |
|---|---|---|---|
| 3,526,972 | A | 9/1970 | Sumpf |
| 3,573,868 | A | 4/1971 | Giannetti |
| 3,641,676 | A | 2/1972 | Knutsen et al. |
| 3,645,635 | A | 2/1972 | Steck |
| 3,801,205 | A | 4/1974 | Eggenschwyler |
| 3,914,873 | A | 10/1975 | Elliot, Jr. et al. |
| 3,992,783 | A | 11/1976 | Dunlap et al. |
| 3,995,376 | A | 12/1976 | Kimble et al. |
| 4,026,054 | A | 5/1977 | Snyder |
| 4,079,534 | A | 3/1978 | Snyder |
| 4,102,059 | A | 7/1978 | Kimble et al. |
| 4,144,505 | A | 3/1979 | Angelbeck et al. |
| 4,146,329 | A | 3/1979 | King et al. |
| 4,148,245 | A | 4/1979 | Steffanus et al. |
| 4,156,981 | A | 6/1979 | Lusk |
| 4,168,588 | A | 9/1979 | Snyder |
| 4,220,983 | A | 9/1980 | Schroeder |
| 4,222,564 | A | 9/1980 | Allen |
| 4,229,103 | A | 10/1980 | Hipp |
| 4,232,867 | A | 11/1980 | Tate |
| 4,233,770 | A | 11/1980 | de Filippis et al. |
| 4,234,911 | A | 11/1980 | Faith |
| 4,295,289 | A | 10/1981 | Snyder |
| 4,305,091 | A | 12/1981 | Cooper |
| 4,348,828 | A | 9/1982 | Snyder |
| 4,352,665 | A | 10/1982 | Kimble et al. |
| 4,481,561 | A | 11/1984 | Lanning |
| 4,488,369 | A | 12/1984 | Van Note |
| 4,541,191 | A | 9/1985 | Morris et al. |
| 4,567,810 | A | 2/1986 | Preston |
| 4,713,889 | A | 12/1987 | Santiago |
| 4,763,431 | A | 8/1988 | Allan et al. |
| 4,825,258 | A | 4/1989 | Whitson |
| 4,830,617 | A | 5/1989 | Hancox et al. |
| 4,876,816 | A | 10/1989 | Triplett |
| 4,878,307 | A | 11/1989 | Singletary |
| 4,891,476 | A | 1/1990 | Nation et al. |
| 4,934,086 | A | 6/1990 | Houde-Walter |
| 4,939,320 | A | 7/1990 | Graulty |
| 4,939,863 | A | 7/1990 | Alexander et al. |
| 4,945,667 | A | 8/1990 | Rogalski et al. |
| 4,953,316 | A | 9/1990 | Litton et al. |
| 4,967,642 | A | 11/1990 | Mihaita |
| 5,001,836 | A | 3/1991 | Cameron et al. |
| 5,033,219 | A | 7/1991 | Johnson et al. |
| 5,048,211 | A | 9/1991 | Hepp |
| 5,048,215 | A | 9/1991 | Davis |
| 5,052,138 | A | 10/1991 | Crain |
| 5,090,805 | A | 2/1992 | Stawarz |
| 5,177,309 | A | 1/1993 | Willoughby et al. |
| 5,178,265 | A | 1/1993 | Sepke |
| 5,179,124 | A | 1/1993 | Schoenwald et al. |
| 5,179,235 | A | 1/1993 | Toole |
| 5,208,826 | A | 5/1993 | Kelly |
| 5,228,427 | A | 7/1993 | Gardner |
| 5,237,773 | A | 8/1993 | Claridge |
| 5,241,146 | A | 8/1993 | Priesemuth |
| 5,272,514 | A | 12/1993 | Dor |
| 5,299,375 | A | 4/1994 | Thummel et al. |
| 5,343,376 | A | 8/1994 | Huang |
| 5,355,608 | A | 10/1994 | Teetzel |
| 5,355,609 | A | 10/1994 | Schenke |
| 5,365,669 | A | 11/1994 | Rustick et al. |
| 5,367,779 | A | 11/1994 | Lee |
| 5,373,644 | A | 12/1994 | De Paoli |
| 5,375,362 | A | 12/1994 | McGarry et al. |
| 5,388,335 | A | 2/1995 | Jung |
| 5,392,550 | A | 2/1995 | Moore et al. |
| 5,400,540 | A | 3/1995 | Solinsky et al. |
| 5,419,072 | A | 5/1995 | Moore et al. |
| 5,432,598 | A | 7/1995 | Szatkowski |
| 5,435,091 | A | 7/1995 | Toole et al. |
| 5,446,535 | A | 8/1995 | Williams |
| 5,448,834 | A | 9/1995 | Huang |
| 5,454,168 | A | 10/1995 | Langner |
| 5,455,397 | A | 10/1995 | Havenhill et al. |
| 5,467,552 | A | 11/1995 | Cupp et al. |
| 5,481,819 | A | 1/1996 | Teetzel |
| 5,488,795 | A | 2/1996 | Sweat |
| D368,121 | S | 3/1996 | Lam |
| 5,499,455 | A | 3/1996 | Palmer |
| 5,509,226 | A | 4/1996 | Houde-Walter |
| 5,515,636 | A | 5/1996 | McGarry et al. |
| 5,531,040 | A | 7/1996 | Moore |
| 5,555,662 | A | 9/1996 | Teetzel |
| 5,557,872 | A | 9/1996 | Langner |
| 5,566,459 | A | 10/1996 | Breda |
| 5,581,898 | A | 12/1996 | Thummel |
| 5,584,137 | A | 12/1996 | Teetzel |
| 5,590,486 | A | 1/1997 | Moore |
| 5,598,958 | A | 2/1997 | Ryan, III et al. |
| 5,618,099 | A | 4/1997 | Brubacher |
| 5,621,999 | A | 4/1997 | Moore |
| 5,622,000 | A | 4/1997 | Marlowe |
| 5,669,174 | A | 9/1997 | Teetzel |
| 5,671,561 | A | 9/1997 | Johnson et al. |
| 5,685,106 | A | 11/1997 | Shoham |
| 5,685,636 | A | 11/1997 | German |
| 5,694,202 | A | 12/1997 | Mladjan et al. |
| 5,694,713 | A | 12/1997 | Paldino |
| 5,704,153 | A | 1/1998 | Kaminski et al. |
| 5,706,600 | A | 1/1998 | Toole et al. |
| 5,735,070 | A | 4/1998 | Vasquez et al. |
| 5,787,631 | A | 8/1998 | Kendall |
| 5,788,500 | A | 8/1998 | Gerber |
| 5,822,905 | A | 10/1998 | Teetzel |
| 5,842,300 | A | 12/1998 | Cheshelski et al. |
| 5,847,345 | A | 12/1998 | Harrison |
| 5,867,930 | A | 2/1999 | Kaminski et al. |
| 5,881,707 | A | 3/1999 | Gardner |
| 5,892,221 | A | 4/1999 | Lev |
| 5,896,691 | A | 4/1999 | Kaminski et al. |
| 5,905,238 | A | 5/1999 | Hung |
| 5,909,951 | A | 6/1999 | Johnsen et al. |
| 5,922,030 | A | 7/1999 | Shank et al. |
| 5,967,133 | A | 10/1999 | Gardner |
| 5,983,774 | A | 11/1999 | Mihaita |
| 6,003,504 | A | 12/1999 | Rice et al. |
| 6,023,875 | A | 2/2000 | Fell et al. |
| 6,035,843 | A | 3/2000 | Smith et al. |
| 6,146,141 | A | 11/2000 | Schumann |
| 6,151,788 | A | 11/2000 | Cox et al. |
| 6,219,952 | B1 | 4/2001 | Mossberg et al. |
| 6,230,431 | B1 | 5/2001 | Bear |
| 6,237,271 | B1 | 5/2001 | Kaminski |
| 6,282,829 | B1 | 9/2001 | Mossberg et al. |
| 6,289,624 | B1 | 9/2001 | Hughes et al. |
| 6,293,869 | B1 | 9/2001 | Kwan et al. |
| 6,295,753 | B1 | 10/2001 | Thummel |
| 6,301,046 | B1 | 10/2001 | Tai et al. |
| 6,318,228 | B1 | 11/2001 | Thompson |
| 6,327,806 | B1 | 12/2001 | Paige |
| 6,345,464 | B1 | 2/2002 | Kim et al. |
| 6,363,648 | B1 | 4/2002 | Kranich et al. |
| 6,366,349 | B1 | 4/2002 | Houde-Walter |
| 6,371,004 | B1 | 4/2002 | Peterson |
| 6,385,893 | B1 | 5/2002 | Cheng |
| 6,389,729 | B2 | 5/2002 | Rauch et al. |
| 6,389,730 | B1 | 5/2002 | Millard |
| 6,397,509 | B1 | 6/2002 | Langner |
| 6,430,861 | B1 | 8/2002 | Ayers et al. |
| 6,434,874 | B1 | 8/2002 | Hines |
| 6,442,880 | B1 | 9/2002 | Allan |
| 6,487,807 | B1 | 12/2002 | Kopman et al. |
| 6,499,247 | B1 | 12/2002 | Peterson |
| 6,526,688 | B1 | 3/2003 | Danielson et al. |
| 6,568,118 | B1 | 5/2003 | Teetzel |
| 6,572,375 | B2 | 6/2003 | Shechter et al. |
| 6,575,753 | B2 | 6/2003 | Rosa et al. |
| 6,578,311 | B2 | 6/2003 | Danielson et al. |
| 6,579,098 | B2 | 6/2003 | Shechter |
| 6,591,536 | B2 | 7/2003 | Houde-Walter et al. |
| 6,606,797 | B1 | 8/2003 | Gandy |
| 6,616,452 | B2 | 9/2003 | Clark et al. |

(56) References Cited

U.S. PATENT DOCUMENTS

| | | | |
|---|---|---|---|
| 6,622,414 | B1 | 9/2003 | Oliver et al. |
| 6,631,580 | B2 | 10/2003 | Iafrate |
| 6,631,668 | B1 | 10/2003 | Wilson et al. |
| 6,650,669 | B1 | 11/2003 | Adkins |
| 6,671,991 | B1 | 1/2004 | Danielson |
| D487,791 | S | 3/2004 | Freed |
| 6,742,299 | B2 | 6/2004 | Strand |
| 6,782,789 | B2 | 8/2004 | McNulty |
| 6,854,205 | B2 | 2/2005 | Wikle et al. |
| 6,931,775 | B2 | 8/2005 | Burnett |
| 6,935,864 | B2 | 8/2005 | Shechter et al. |
| 6,966,775 | B1 | 11/2005 | Kendir et al. |
| 7,032,342 | B2 | 4/2006 | Pikielny |
| 7,049,575 | B2 | 5/2006 | Hotelling |
| 7,111,424 | B1 | 9/2006 | Moody et al. |
| 7,121,034 | B2 | 10/2006 | Keng |
| 7,134,234 | B1 | 11/2006 | Makarounis |
| 7,191,557 | B2 | 3/2007 | Gablowski et al. |
| D542,446 | S | 5/2007 | DiCarlo et al. |
| 7,218,501 | B2 | 5/2007 | Keely |
| 7,237,352 | B2 | 7/2007 | Keely et al. |
| 7,243,454 | B1 | 7/2007 | Cahill |
| 7,260,910 | B2 | 8/2007 | Danielson |
| 7,264,369 | B1 | 9/2007 | Howe |
| 7,303,306 | B2 | 12/2007 | Ross et al. |
| 7,305,790 | B2 | 12/2007 | Kay |
| 7,329,127 | B2 | 2/2008 | Kendir et al. |
| 7,331,137 | B2 | 2/2008 | Hsu |
| D567,894 | S | 4/2008 | Sterling et al. |
| 7,360,333 | B2 | 4/2008 | Kim |
| D570,948 | S | 6/2008 | Cerovic et al. |
| RE40,429 | E | 7/2008 | Oliver et al. |
| D578,599 | S | 10/2008 | Cheng |
| 7,441,364 | B2 | 10/2008 | Rogers et al. |
| 7,453,918 | B2 | 11/2008 | Laughman et al. |
| 7,454,858 | B2 | 11/2008 | Griffin |
| 7,464,495 | B2 | 12/2008 | Cahill |
| 7,472,830 | B2 | 1/2009 | Danielson |
| D586,874 | S | 2/2009 | Moody et al. |
| 7,490,429 | B2 | 2/2009 | Moody et al. |
| 7,578,089 | B1 | 8/2009 | Griffin |
| 7,584,569 | B2 | 9/2009 | Kallio |
| 7,591,098 | B2 | 9/2009 | Matthews et al. |
| D602,109 | S | 10/2009 | Cerovic et al. |
| 7,603,997 | B2 | 10/2009 | Hensel et al. |
| D603,478 | S | 11/2009 | Hughes |
| 7,624,528 | B1 | 12/2009 | Bell et al. |
| 7,627,976 | B1 | 12/2009 | Olson |
| 7,644,530 | B2 | 1/2010 | Scherpf |
| 7,652,216 | B2 | 1/2010 | Sharrah et al. |
| D612,756 | S | 3/2010 | D'Amelio et al. |
| D612,757 | S | 3/2010 | D'Amelio et al. |
| 7,674,003 | B2 | 3/2010 | Sharrah et al. |
| 7,676,975 | B2 | 3/2010 | Phillips et al. |
| 7,685,756 | B2 | 3/2010 | Moody et al. |
| 7,698,847 | B2 | 4/2010 | Griffin |
| 7,703,719 | B1 | 4/2010 | Bell et al. |
| 7,712,241 | B2 | 5/2010 | Teetzel et al. |
| D616,957 | S | 6/2010 | Rievley et al. |
| 7,726,059 | B2 | 6/2010 | Pikielny |
| 7,726,061 | B1 | 6/2010 | Thummel |
| 7,730,820 | B2 | 6/2010 | Vice et al. |
| 7,743,546 | B2 | 6/2010 | Keng |
| 7,743,547 | B2 | 6/2010 | Houde-Walter |
| 7,753,549 | B2 | 7/2010 | Solinsky et al. |
| 7,771,077 | B2 | 8/2010 | Miller |
| 7,797,843 | B1 | 9/2010 | Scott et al. |
| 7,805,876 | B1 | 10/2010 | Danielson et al. |
| 7,818,910 | B2 | 10/2010 | Young |
| 7,827,726 | B2 | 11/2010 | Stokes |
| 7,841,120 | B2 | 11/2010 | Teetzel et al. |
| 7,880,100 | B2 | 2/2011 | Sharrah et al. |
| 7,900,390 | B2 | 3/2011 | Moody et al. |
| 7,913,439 | B2 | 3/2011 | Whaley |
| D636,049 | S | 4/2011 | Hughes et al. |
| D636,837 | S | 4/2011 | Hughes et al. |
| 7,921,591 | B1 | 4/2011 | Adcock |
| 7,926,218 | B2 | 4/2011 | Matthews et al. |
| 7,997,023 | B2 | 8/2011 | Moore et al. |
| 8,001,715 | B2 | 8/2011 | Stokes |
| 8,006,427 | B2 | 8/2011 | Blevins et al. |
| 8,006,428 | B2 | 8/2011 | Moore et al. |
| 8,028,460 | B2 | 10/2011 | Williams |
| 8,028,461 | B2 | 10/2011 | NuDyke |
| 8,050,307 | B2 | 11/2011 | Day et al. |
| 8,056,277 | B2 | 11/2011 | Griffin |
| 8,093,992 | B2 | 1/2012 | Jancie et al. |
| 8,104,220 | B2 | 1/2012 | Cobb |
| D653,798 | S | 2/2012 | Janice et al. |
| 8,109,024 | B2 | 2/2012 | Abst |
| 8,110,760 | B2 | 2/2012 | Sharrah et al. |
| 8,132,354 | B1 | 3/2012 | Sellers et al. |
| 8,136,284 | B2 | 3/2012 | Moody et al. |
| 8,141,288 | B2 | 3/2012 | Dodd et al. |
| 8,146,282 | B2 | 4/2012 | Cabahug et al. |
| 8,151,504 | B1 | 4/2012 | Aiston |
| 8,151,505 | B2 | 4/2012 | Thompson |
| 8,166,694 | B2 | 5/2012 | Swan |
| 8,172,139 | B1 | 5/2012 | McDonald et al. |
| D661,366 | S | 6/2012 | Zusman |
| 8,196,328 | B2 | 6/2012 | Simpkins |
| 8,215,047 | B2 | 7/2012 | Ash et al. |
| 8,225,542 | B2 | 7/2012 | Houde-Walter |
| 8,225,543 | B2 | 7/2012 | Moody et al. |
| 8,245,428 | B2 | 8/2012 | Griffin |
| 8,245,434 | B2 | 8/2012 | Hogg et al. |
| 8,256,154 | B2 | 9/2012 | Danielson et al. |
| 8,258,416 | B2 | 9/2012 | Sharrah et al. |
| D669,552 | S | 10/2012 | Essig et al. |
| D669,553 | S | 10/2012 | Hughes et al. |
| D669,957 | S | 10/2012 | Hughes et al. |
| D669,958 | S | 10/2012 | Essig et al. |
| D669,959 | S | 10/2012 | Johnston et al. |
| D670,785 | S | 11/2012 | Fitzpatrick et al. |
| 8,312,666 | B2 | 11/2012 | Moore et al. |
| D672,005 | S | 12/2012 | Hedeen et al. |
| 8,322,064 | B2 | 12/2012 | Cabahug et al. |
| 8,335,413 | B2 | 12/2012 | Dromaretsky et al. |
| D674,861 | S | 1/2013 | Johnston et al. |
| D674,862 | S | 1/2013 | Johnston et al. |
| D675,281 | S | 1/2013 | Speroni |
| 8,341,868 | B2 | 1/2013 | Zusman |
| 8,347,541 | B1 | 1/2013 | Thompson |
| 8,356,818 | B2 | 1/2013 | Mraz |
| 8,360,598 | B2 | 1/2013 | Sharrah et al. |
| D676,097 | S | 2/2013 | Izumi |
| 8,365,456 | B1 | 2/2013 | Shepard |
| D677,433 | S | 3/2013 | Swan et al. |
| D678,976 | S | 3/2013 | Pittman |
| 8,387,294 | B2 | 3/2013 | Bolden |
| 8,393,104 | B1 | 3/2013 | Moody et al. |
| 8,393,105 | B1 | 3/2013 | Thummel |
| 8,397,418 | B2 | 3/2013 | Cabahug et al. |
| 8,402,683 | B2 | 3/2013 | Cabahug et al. |
| 8,413,362 | B2 | 4/2013 | Houde-Walter |
| D682,977 | S | 5/2013 | Thummel et al. |
| 8,443,539 | B2 | 5/2013 | Cabahug et al. |
| 8,444,291 | B2 | 5/2013 | Swan et al. |
| 8,448,368 | B2 | 5/2013 | Cabahug et al. |
| 8,458,944 | B2 | 6/2013 | Houde-Walter |
| 8,467,430 | B2 | 6/2013 | Caffey et al. |
| 8,468,734 | B2 | 6/2013 | Meller et al. |
| 8,468,930 | B1 | 6/2013 | Bell |
| D687,120 | S | 7/2013 | Hughes et al. |
| 8,480,329 | B2 | 7/2013 | Fluhr et al. |
| 8,484,880 | B1 | 7/2013 | Sellers et al. |
| 8,484,882 | B2 | 7/2013 | Haley et al. |
| 8,485,686 | B2 | 7/2013 | Swan et al. |
| 8,510,981 | B1 | 8/2013 | Ganther et al. |
| 8,516,731 | B2 | 8/2013 | Cabahug et al. |
| 8,567,981 | B2 | 10/2013 | Finnegan et al. |
| 8,584,587 | B2 | 11/2013 | Uhr |
| 8,607,495 | B2 | 12/2013 | Moore et al. |
| D697,162 | S | 1/2014 | Faifer |

(56) References Cited

U.S. PATENT DOCUMENTS

| | | | | |
|---|---|---|---|---|
| 8,661,725 | B1 | 3/2014 | Ganther et al. | |
| 8,662,694 | B1 | 3/2014 | Izumi et al. | |
| 8,734,156 | B2 | 5/2014 | Uhr | |
| 8,739,447 | B2 | 6/2014 | Merritt et al. | |
| 8,807,779 | B1 | 8/2014 | Izumi et al. | |
| 8,813,411 | B2 | 8/2014 | Moore et al. | |
| 8,844,189 | B2 | 9/2014 | Moore et al. | |
| 8,919,023 | B2 | 12/2014 | Merritt et al. | |
| 8,938,904 | B1 | 1/2015 | Sellers et al. | |
| 8,944,838 | B2 | 2/2015 | Mulfinger | |
| 9,146,077 | B2 | 9/2015 | Moore | |
| 9,182,194 | B2 | 11/2015 | Moore | |
| 9,188,407 | B2 | 11/2015 | Moore | |
| 9,297,614 | B2 | 3/2016 | Moore | |
| 2001/0042335 | A1 | 11/2001 | Strand | |
| 2002/0009694 | A1 | 1/2002 | Rosa | |
| 2002/0051953 | A1 | 5/2002 | Clark et al. | |
| 2002/0057719 | A1 | 5/2002 | Shechter | |
| 2002/0073561 | A1 | 6/2002 | Liao | |
| 2002/0129536 | A1 | 9/2002 | Iafrate et al. | |
| 2002/0134000 | A1 | 9/2002 | Varshneya et al. | |
| 2002/0194767 | A1 | 12/2002 | Houde-Walter et al. | |
| 2003/0003424 | A1 | 1/2003 | Shechter et al. | |
| 2003/0029072 | A1 | 2/2003 | Danielson | |
| 2003/0175661 | A1 | 9/2003 | Shechter et al. | |
| 2003/0180692 | A1 | 9/2003 | Skala et al. | |
| 2003/0196366 | A1 | 10/2003 | Beretta | |
| 2004/0003529 | A1 | 1/2004 | Danielson | |
| 2004/0010956 | A1 | 1/2004 | Bubits | |
| 2004/0014010 | A1 | 1/2004 | Swensen et al. | |
| 2005/0044736 | A1 | 3/2005 | Liao | |
| 2005/0130739 | A1 | 6/2005 | Argentar | |
| 2005/0153262 | A1 | 7/2005 | Kendir | |
| 2005/0185403 | A1 | 8/2005 | Diehl | |
| 2005/0188588 | A1 | 9/2005 | Keng | |
| 2005/0241209 | A1 | 11/2005 | Staley | |
| 2005/0257415 | A1 | 11/2005 | Solinsky et al. | |
| 2005/0268519 | A1 | 12/2005 | Pikielny | |
| 2006/0162225 | A1 | 7/2006 | Danielson | |
| 2006/0191183 | A1 | 8/2006 | Griffin | |
| 2007/0039226 | A1 | 2/2007 | Stokes | |
| 2007/0041418 | A1 | 2/2007 | Laughman et al. | |
| 2007/0056203 | A1 | 3/2007 | Gering et al. | |
| 2007/0113460 | A1 | 5/2007 | Potterfield et al. | |
| 2007/0190495 | A1 | 8/2007 | Kendir et al. | |
| 2007/0258236 | A1 | 11/2007 | Miller | |
| 2007/0271832 | A1 | 11/2007 | Griffin | |
| 2008/0000133 | A1 | 1/2008 | Solinsky et al. | |
| 2008/0060248 | A1 | 3/2008 | Pine et al. | |
| 2008/0134562 | A1 | 6/2008 | Teetzel | |
| 2009/0013580 | A1 | 1/2009 | Houde-Walter | |
| 2009/0013581 | A1 | 1/2009 | LoRocco | |
| 2009/0178325 | A1 | 7/2009 | Veilleux | |
| 2009/0183416 | A1 | 7/2009 | Danielson | |
| 2009/0293335 | A1 | 12/2009 | Danielson | |
| 2009/0293855 | A1 | 12/2009 | Danielson | |
| 2009/0323733 | A1* | 12/2009 | Charkas | A61C 1/0046 372/5 |
| 2010/0058640 | A1 | 3/2010 | Moore et al. | |
| 2010/0162610 | A1 | 7/2010 | Moore et al. | |
| 2010/0175297 | A1 | 7/2010 | Speroni | |
| 2010/0229448 | A1 | 9/2010 | Houde-Walter | |
| 2010/0275496 | A1 | 11/2010 | Solinsky et al. | |
| 2011/0047850 | A1 | 3/2011 | Rievley et al. | |
| 2011/0061283 | A1 | 3/2011 | Cavallo | |
| 2011/0074303 | A1 | 3/2011 | Stokes | |
| 2011/0162249 | A1 | 7/2011 | Woodmansee et al. | |
| 2011/0185619 | A1 | 8/2011 | Finnegan et al. | |
| 2012/0005938 | A1* | 1/2012 | Sloan | F41G 1/40 42/113 |
| 2012/0047787 | A1 | 3/2012 | Curry | |
| 2012/0055061 | A1 | 3/2012 | Hartley et al. | |
| 2012/0110886 | A1 | 5/2012 | Moore et al. | |
| 2012/0124885 | A1 | 5/2012 | Caulk et al. | |
| 2012/0144716 | A1 | 6/2012 | Cabahug et al. | |
| 2012/0180366 | A1 | 7/2012 | Jaroh et al. | |
| 2012/0180367 | A1 | 7/2012 | Singh | |
| 2012/0180370 | A1 | 7/2012 | McKinley | |
| 2012/0224357 | A1 | 9/2012 | Moore | |
| 2013/0185978 | A1 | 7/2013 | Dodd et al. | |
| 2013/0185982 | A1 | 7/2013 | Hilbourne et al. | |
| 2013/0263492 | A1 | 10/2013 | Erdle | |
| 2014/0007485 | A1 | 1/2014 | Castejon | |
| 2014/0109457 | A1 | 4/2014 | Speroni | |
| 2014/0355258 | A1 | 12/2014 | Izumi et al. | |
| 2015/0345905 | A1* | 12/2015 | Hancosky | F41G 1/35 42/113 |

OTHER PUBLICATIONS

USPTO; Notice of Allowance dated Jun. 24, 2015 in U.S. Appl. No. 14/316,688.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
EPO; Office Action dated Oct. 5, 2011 in Serial No. 09169459.
EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 0969469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.

(56) References Cited

OTHER PUBLICATIONS

USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Nov. 21, 2013 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014 in U.S. Appl. No. 13/707,312.
USPTO; Notice of Allowance dated Jun. 11, 2014 in U.S. Appl. No. 13/707,312.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Office Action dated Mar. 3, 2015 in U.S. Appl. No. 14/278,315.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.

* cited by examiner

WEAPON WITH REDIRECTED LIGHTING BEAM

CROSS-REFERENCE TO RELATED APPLICATIONS

This application claims priority to U.S. Provisional Patent Application No. 61/984,655 filed Apr. 25, 2014 and entitled "WEAPON WITH REDIRECTED LIGHTING BEAM," the respective disclosure of which is incorporated herein by reference.

FIELD OF THE INVENTION

The present invention is directed to a lighting device for a firearm that uses a mirror to redirect the light beam along the side or top of the firearm and preferably parallel to the longitudinal axis of the firearm's barrel.

BACKGROUND OF THE INVENTION

As used herein, "light source" means any source of light, such as a laser or flashlight. "Laser" means any form of laser light source that projects a beam of laser light suitable for weapon alignment or sighting purposes.

It is known to utilize a light beam, such as a beam from a laser, as a sighting aid for weapons, particularly guns. A laser beam is preferred because it has comparatively high intensity, can be focused into a narrow beam with a small divergence angle so it produces a small, bright spot on a target. When the light beam and gun bore are properly aligned, the bullet (or other projectile) will hit on or very close to the location of the spot produced by the laser on the target.

It is, however, difficult to mount lasers to small guns, particularly small revolvers, that can be concealed in a pocket or purse. The problem is that the laser and associated mechanisms are too large for the gun. Consequently, they interfere with the operation of the gun and/or make the gun more difficult to conceal.

The disclosures of the following references that are not inconsistent with this disclosure are incorporated herein by reference: U.S. Pat. No. 8,127,485 entitled "GUN WITH MOUNTED SIGHTING DEVICE" to Moore et al., U.S. Pat. No. 8,312,665 entitled "SIDE-MOUNTED LIGHTING DEVICE" to Moore et al. and U.S. patent application Ser. No. 13/707,312 entitled "SIGHTING DEVICE REPLICATING SHOTGUN PATTERN SPREAD" to Moore et al.

SUMMARY OF THE INVENTION

Embodiments of the present invention are mountable on a gun, particularly a small revolver, without interfering with the operation of the gun or affecting the ability to conceal the gun. Disclosed is a laser (or other light source) that is disposed in a grip of the gun. In the embodiments shown, the laser module is mounted at an angle of 0°-45° from the vertical axis and is not positioned so that it is in line with the longitudinal axis of the gun barrel. A mirror is positioned adjacent the end of the laser module that emits light, and the mirror redirects the light, preferably parallel to the longitudinal axis of the gun barrel to enable a user to sight the gun.

DETAILED DESCRIPTION OF PREFERRED EMBODIMENTS

Figure 1:
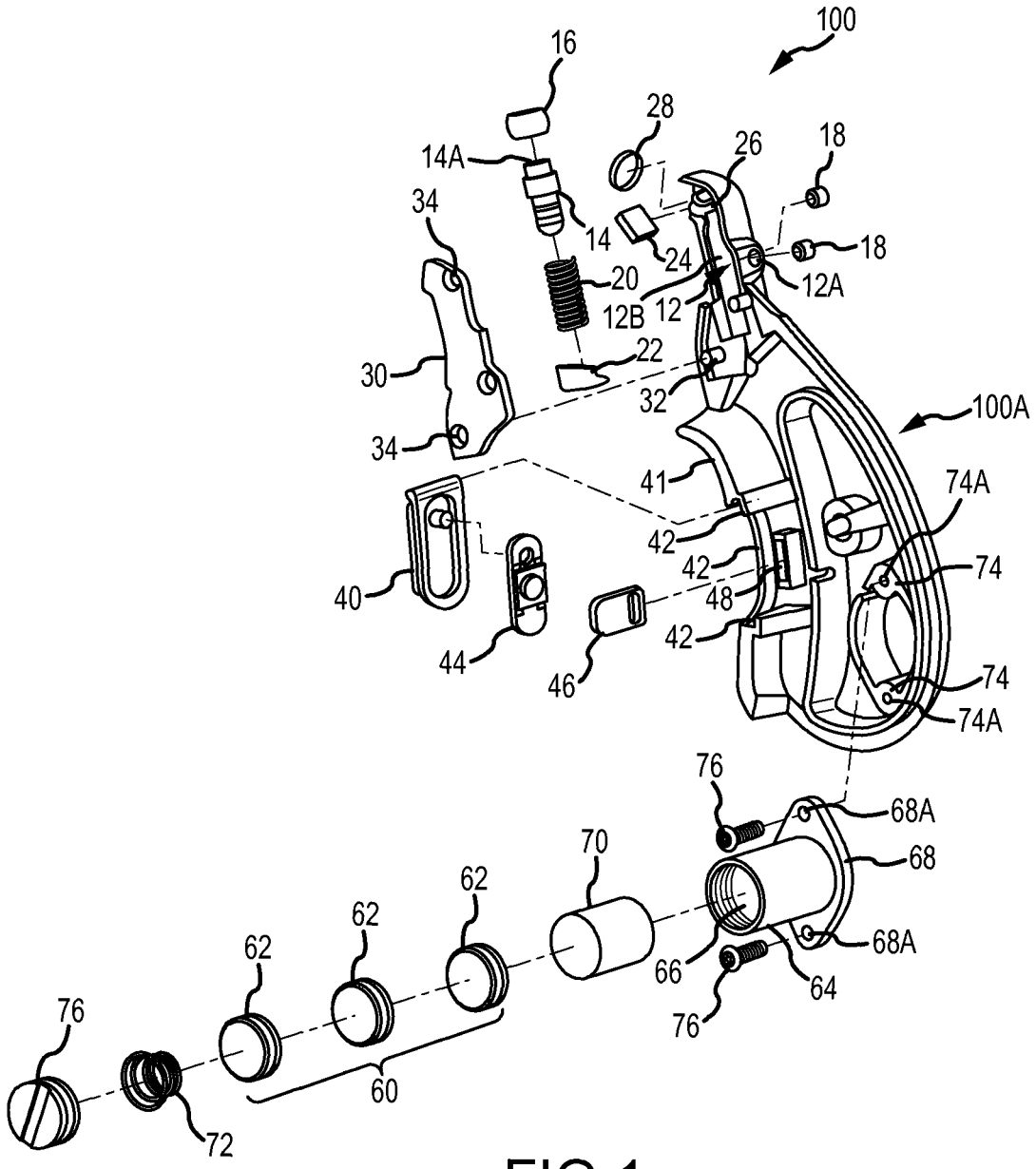
FIG. 1 is an exploded view of a lighting device according to aspects of the invention showing how the device fits onto part of the gun grip.

Turning now to the Figures where the purpose is to describe preferred embodiments of the invention and not limit same, FIG. 1 is an exploded view of a first section 100 of a grip according to aspects of the invention. First section, or grip portion, 100 is preferably made of plastic, metal or a combination thereof and most preferably of injection-molded plastic, and has a main body portion 100A.

In this embodiment, a housing 12 includes a cavity 12B, and is integrally formed as part of first section 100 (although it could be connected to first section 100 in any suitable manner). The cavity 12B of housing 12 is dimensioned to receive laser module 14. In this embodiment module 14 has a first end 14A through which laser light is emitted.

A module nose ball 16 fits over laser module 14 and allows the module 14 to pivot so its position can be adjusted, thereby adjusting the direction of the light beam emitted from end 14A. Housing 12 has an outer wall with two openings 12A, each of which receive a set screw 18 (or other suitable device) that can be tightened or loosened in an opening 12A to alter the position of laser module 14 in housing 12. As shown, the openings 12A and corresponding set screws 18 are positioned 90° apart and are in a axial alignment approximately perpendicular to the longitudinal axis of laser module 14 when module 14 is positioned in cavity 12B of housing 12.

Before laser module 14 is positioned in housing 12, module nose ball 16, a biasing spring 20, and a spring bias insert 22 are positioned on module 14. The combination of spring 20 and spring bias insert 22 bias the laser module 14 towards the two set screws 18. In this manner, as one or more of set screws 18 is loosened the laser module 14 will move in the direction of that set screw(s). Spring 20 may also provide a negative electrical contact for laser module 14.

A mirror 24 fits into a slot 26 integrally formed as part of first section 100. In the embodiment shown, mirror 24 is stationary, but it could be adjustable to adjust, or help adjust, the travel of the light beam emitted from first end 14A. In the embodiment shown, mirror 24 deflects the travel of light emitted from end 14A of laser module 14 so that the light preferably travels along the side or top of a gun, preferably parallel to the axis of the gun barrel, to properly sight a target. Light reflected from the mirror 26 passes through a lens 28. Lens 28 fits onto first section 100 and is transparent, colored, or translucent, and could be a diffraction lens. For example, lens 28 may alter the laser light existing the internal laser module, such as to create a pattern of light, such as a cross hair, vertical beam, horizontal beam, circular pattern of light beams, or circular pattern of light beams with a light beam in the center of the circumference of the circular pattern.

A back cover 30 is positioned onto first section 100 to retain mirror 24, laser module 14, laser module nose ball, spring 20 and spring bias insert 22 in place and protect them. Cover 30 can be attached to first section main body 100A in any suitable fashion but is preferably snap fit into place by projections 32 being received in openings 34. Alternatively, screws could be passed through openings 34 and projections 32 could be threaded or contain screw bosses to retain the screws.

A button, or switch, 40 is preferably a momentary switch that is pressure activated by a user squeezing it. Most preferably a user must apply at least 2, at least 3, or at least 5, pounds of force to activate switch 40 because in that manner a user would not accidentally activate the switch 40 simply by grasping the grip. Alternatively, another type of switch may be used and the switch may be at any suitable location. A PCB 44 is positioned in the back of switch 40. When switch 40 is activated, PCB 44 is moved and it connects the power source 60 to the laser module 14 to emit light from end 14A.

Switch 40 and PCB 44 fit into slot 42 of main body 100A, and there is a corresponding slot (shown in FIG. 2) on second section 200, so that when sections 100 and 200 are connected through the gun handle frame 502, they hold the switch 40 and PCB 44 in place.

A button press tab 46 is retained in slot 48. The power source 60 comprises three 3V photo cell batteries 62, although any suitable power source (preferably a light and portable 3V source) can be used. The power source (batteries 62) in this embodiment are retained in a tube 64 that is preferably cylindrical with a cavity 66 and a mounting board 68 that communicates with PCB 44 when switch 40 is activated.

An insulation sleeve 70 is positioned in cavity 66 and batteries 62 are positioned inside the sleeve 70. Contact board 68 is positioned on frame 74 of main body 100A and is preferably retained in place by screws 76 being positioned through openings 68A and threaded into openings 74A. Insulation sleeve 70 is positioned in cavity 66 and batteries 62 are placed inside sleeve 70. Then spring 72 is placed inside of cavity 66 to bias batteries 62 towards board 68, and a cap 76 is placed on the end of battery tube 64, preferably by threading it onto the end of tube 64, or by any other suitable attachment method.

Figure 2:
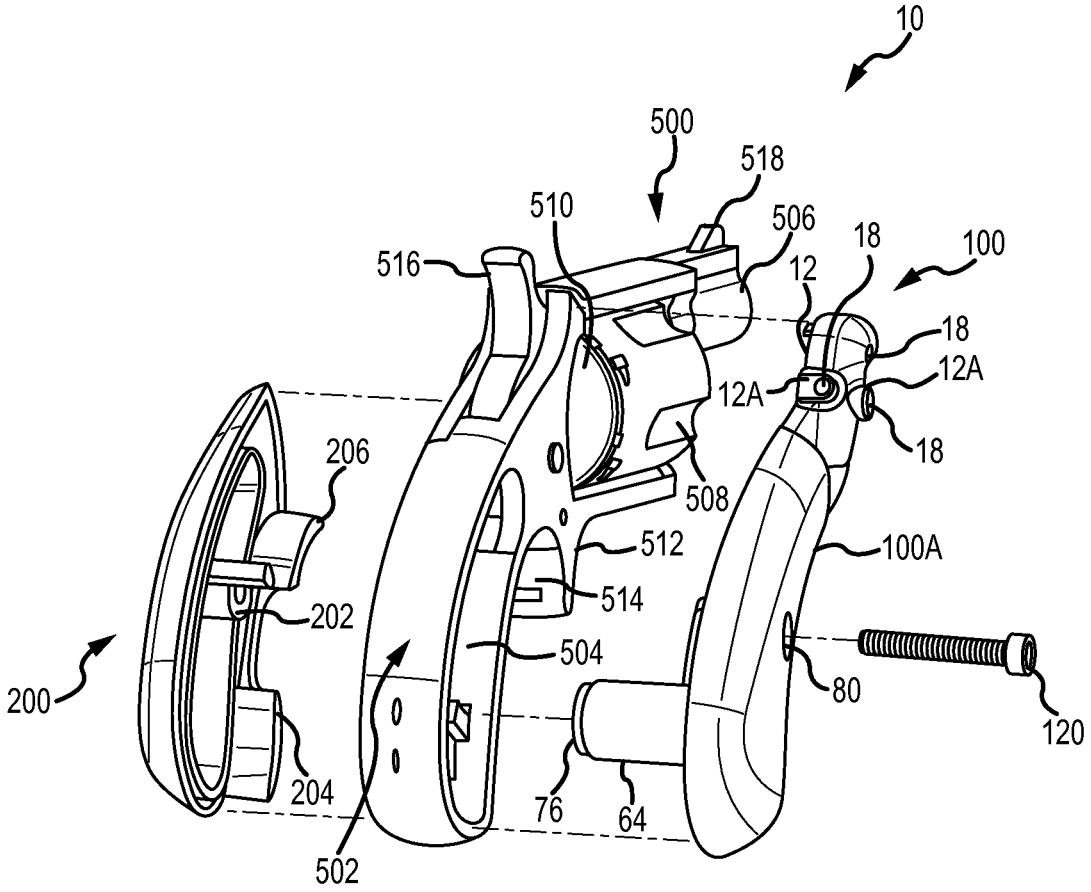
FIG. 2 is a rear, perspective, partially-exploded view of a gun with the lighting device of FIG. 1 not yet assembled on the gun.

FIG. 2 shows an exploded view of a grip according to the invention prior to it being mounted to the handle frame 502 of a revolver 500. In this figure first section 100 is fully assembled. Handle frame 502 has an opening 504 through which portions of first section 100 and second section 200 are pressed together and/or are connected.

Figure 6:
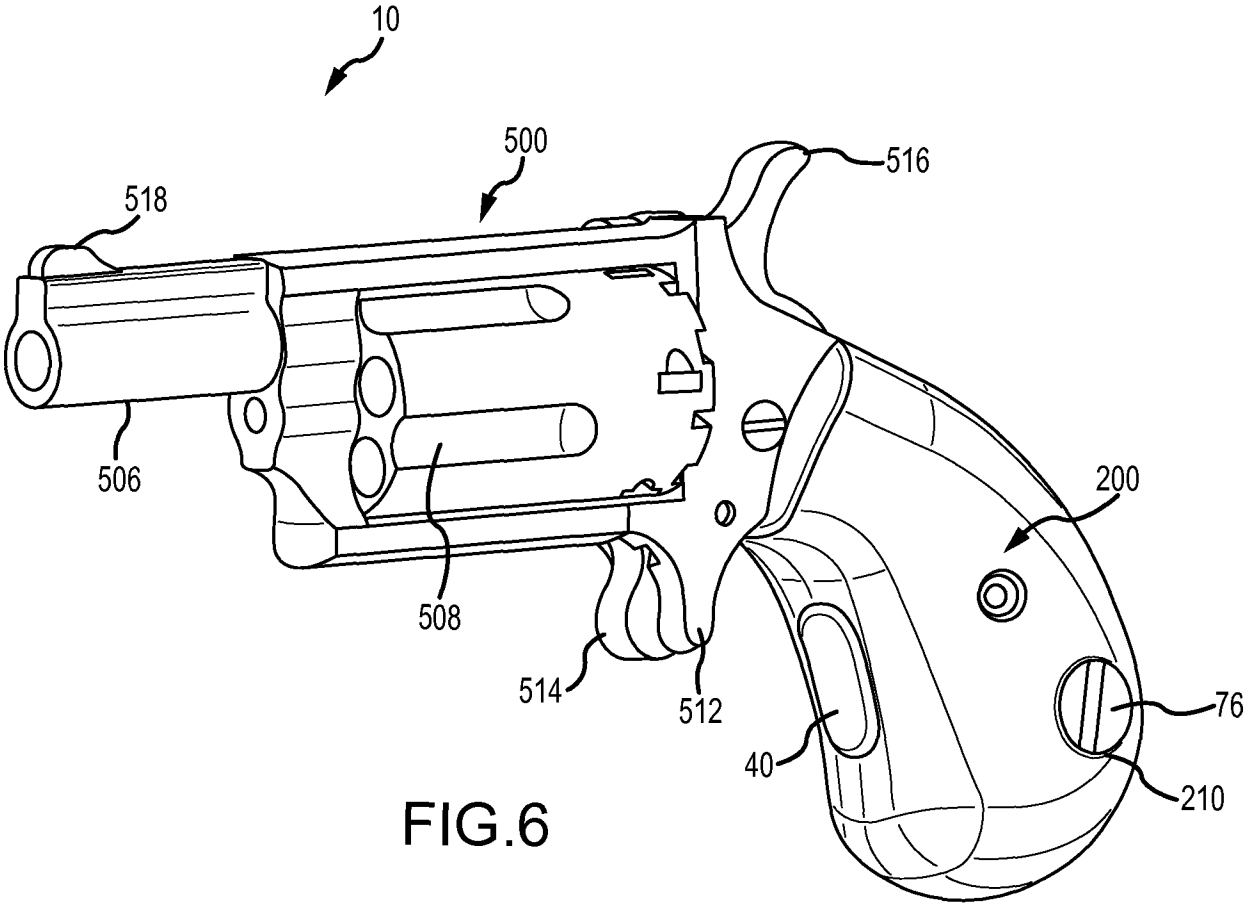
FIG. 6 is a left-side, perspective view of a gun according to FIG. 3.
Figure 7:
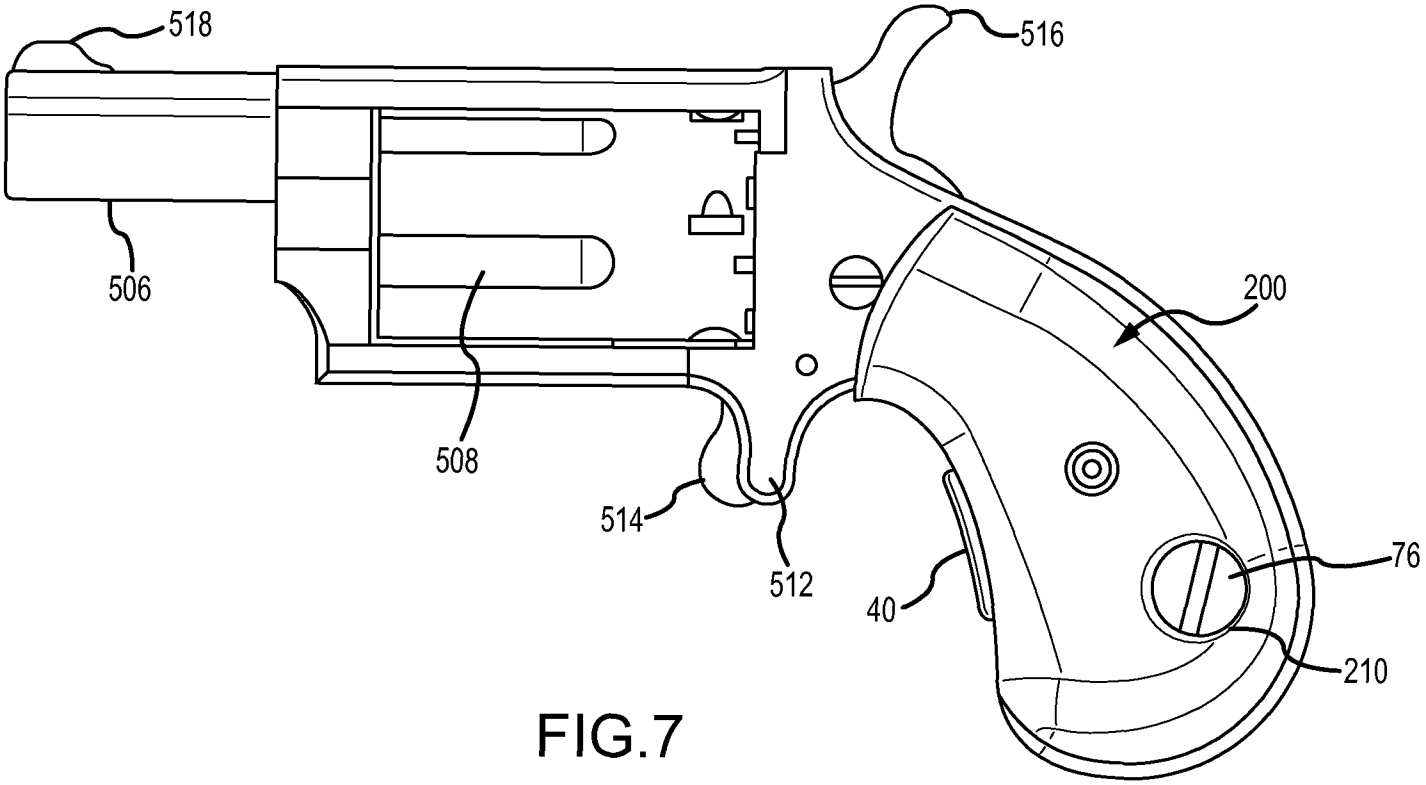
FIG. 7 is a left-side view of a gun according to FIG. 3.
Figure 8:
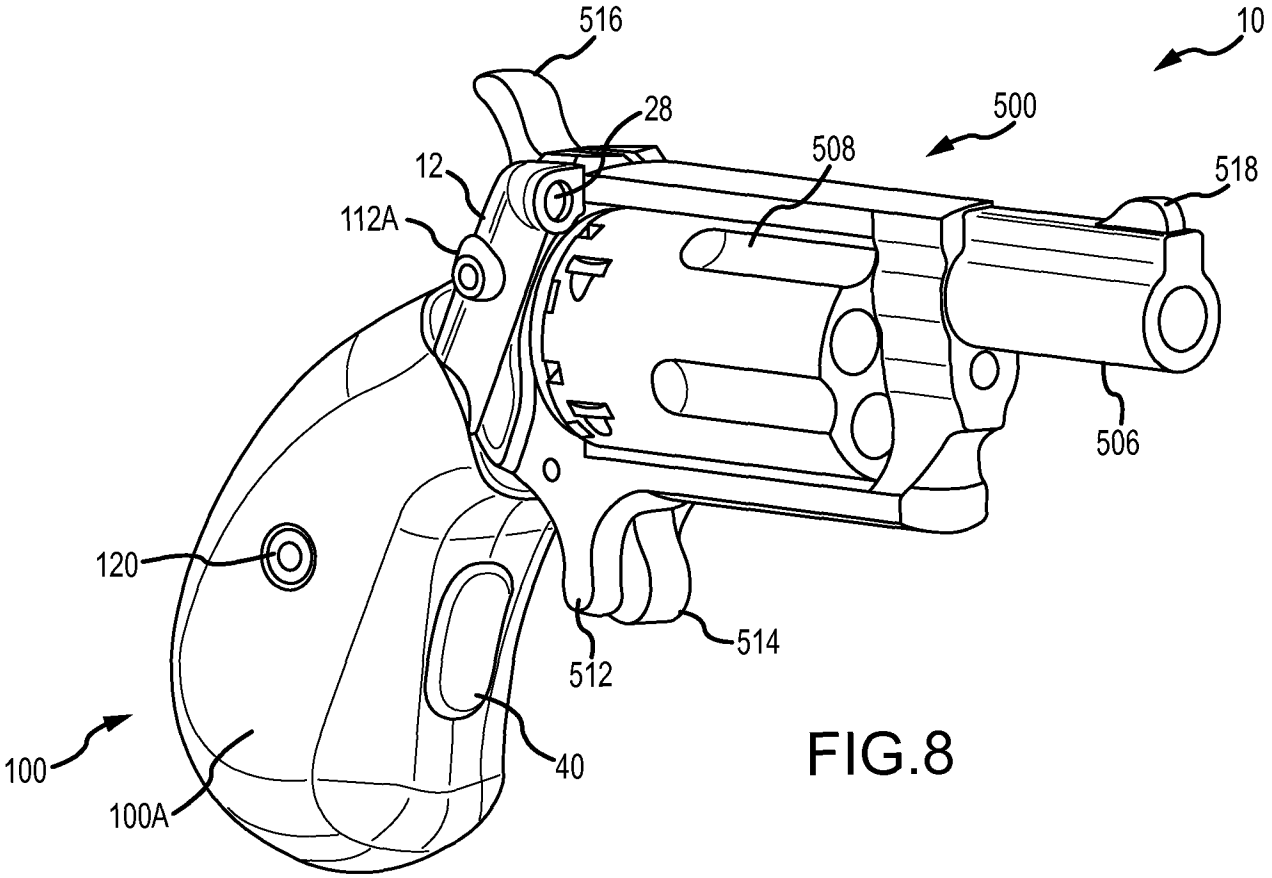
FIG. 8 is a right-side, perspective view of a gun according to FIG. 3.
Figure 9:
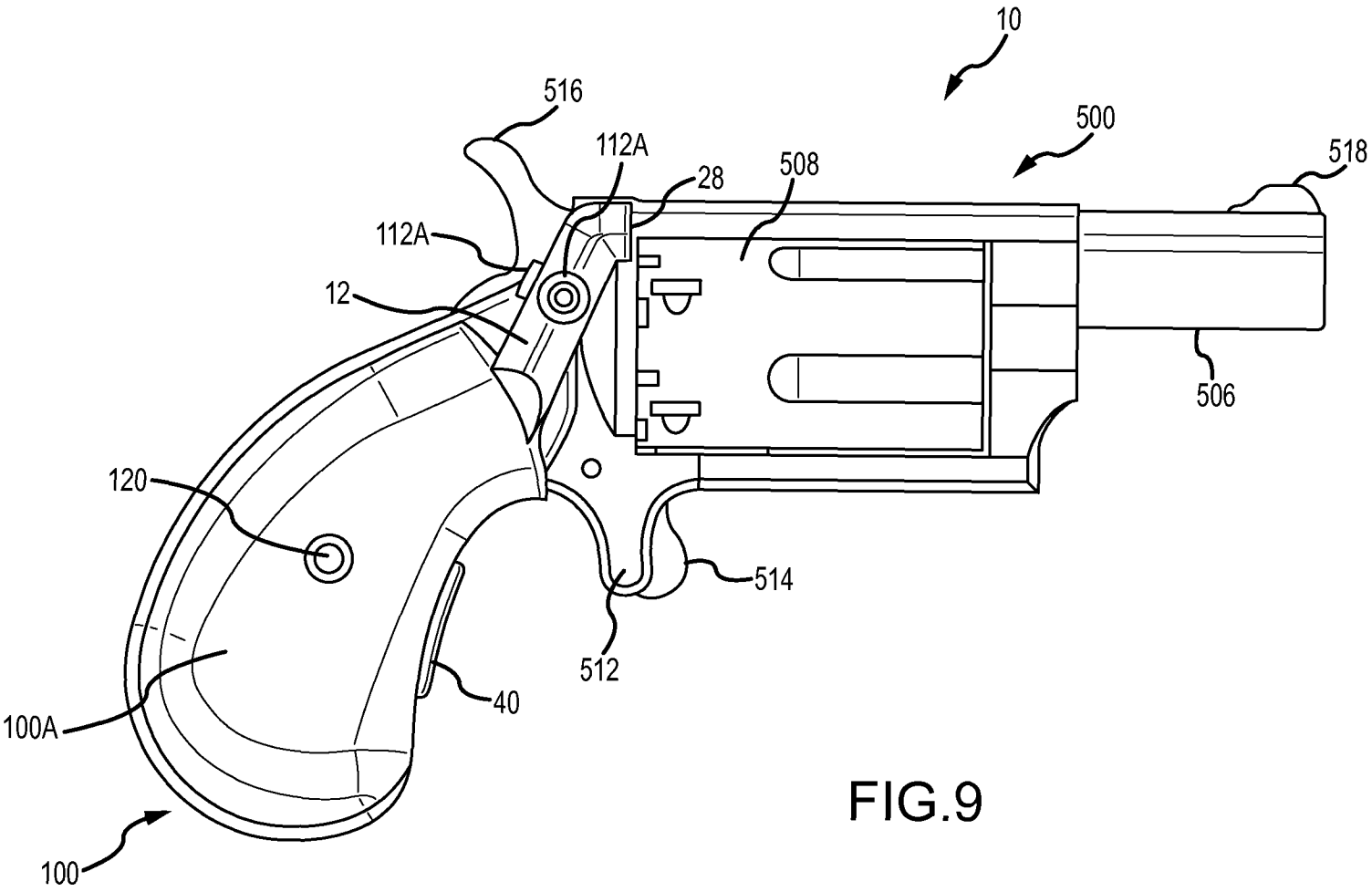
FIG. 9 is a right-side view of a gun according to FIG. 3.

Sections 100 and 200 are pressed against the respective sides of handle frame 502. Screw boss 202 aligns with opening 80, sleeve 204 aligns with slot 42 to retain switch 40, and flange 206 aligns with and presses against flange 41 to create a seal between first section 100 and second section 200. A fastener 120 is passed through opening 80 and threadingly received in screw boss 202 to retain first section 100 and second section 200 in place, although any suitable attachment mechanism may be used. When attached, the cap 76 of battery tube 64 aligns with an opening 210 in second section 200, which can best be seen in FIGS. 6 and 7. In this manner, the battery tube 64 can be easily accessed to remove and replace batteries 62, although any suitable method of battery removal and replacement may be utilized.

In the embodiment shown, the laser module 14 and first section 100 are on the right-hand side of the gun 500. Alternatively, they could be on the left-hand side with first section 100 and second section 200 replaced with respective sections that have the same structures, but reversed.

Figure 3:
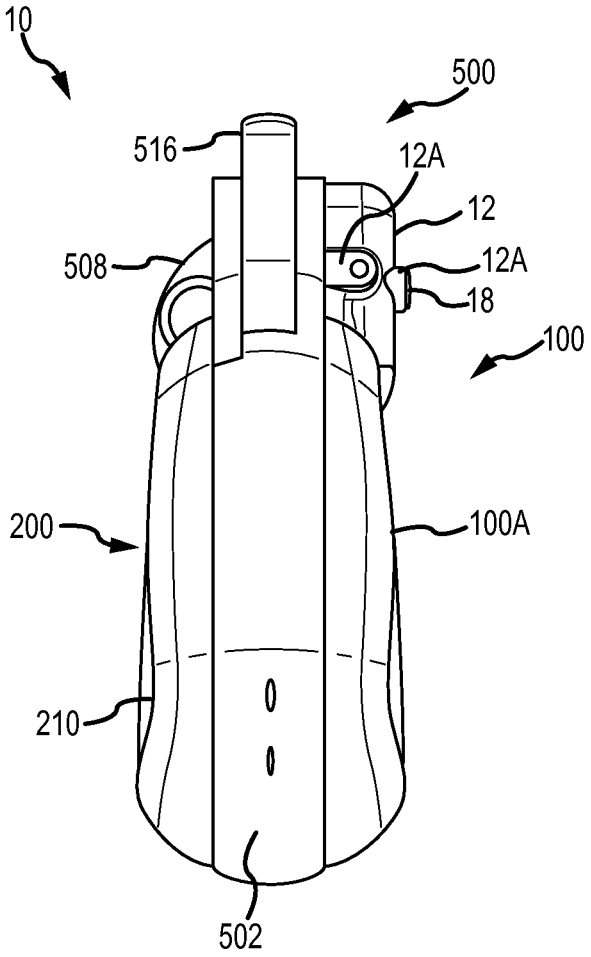
FIG. 3 is a rear view of a gun including a lighting device in accordance with FIGS. 1 and 2.
Figure 4:
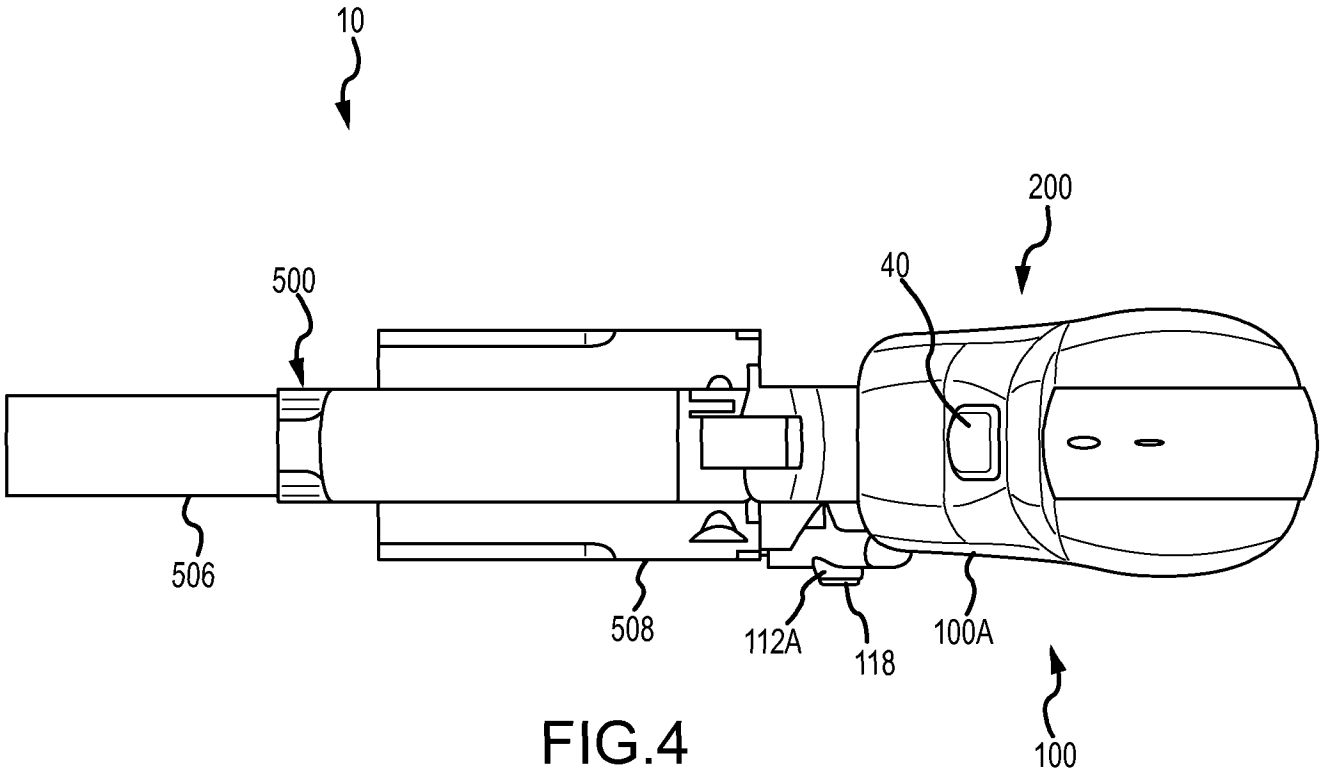
FIG. 4 is a bottom view of the gun according to FIG. 3.
Figure 5:
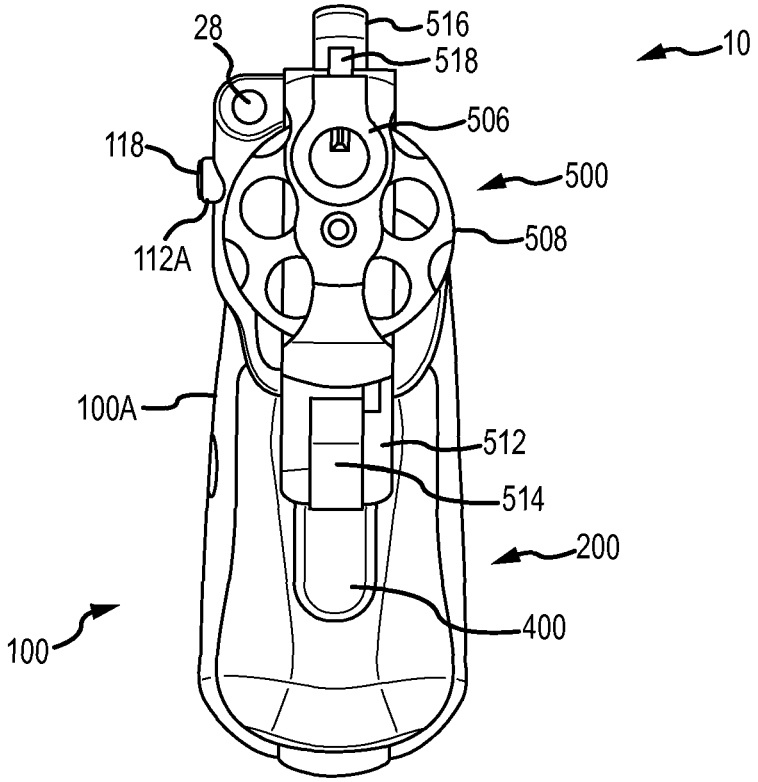
FIG. 5 is a front view of the gun according to FIG. 3.

FIG. 3 is a rear view of device 10. Gun 500 is a revolver with a barrel 506, a cylinder 508 for holding bullets (not shown), an optional back plate 510 (not shown in all figures) that retains the bullets in the cylinder, a trigger guard 512, a trigger 514, a hammer 516 and a mechanical front site 518.

As shown in FIGS. 3-9, the housing 12 and lens 28 are positioned completely behind the trigger guard 512, trigger 14 and cylinder 508 so as to not interfere with the operation of the gun 500. In this embodiment lens 28 is positioned entirely above cylinder 508 so that the light emitted from lens 28 will not be blocked or partially blocked by the cylinder. The housing 12 only extends outward to approximately a position directly even with the outward edge of the cylinder, or by no more than 1/32", 1/16", 1/8" or 1/4" beyond that position. Also, the lens 28 is entirely preferably about 1/32", 1/16", 1/8", or 1/4" above the cylinder.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A lighting device for use with a gun, the lighting device comprising:

(a) a housing connected to a grip of the gun;

(b) a laser module within the housing, the laser module connected to a power source, the laser module having a first end through which laser light is emitted;

(c) a mirror juxtaposed the first end, the mirror for redirecting light emitted from the laser module; and (d) a switch having a first position wherein power is provided to the laser module so the laser module emits light and a second position wherein power is not provided to the laser module and it does not emit light.

2. The lighting device of claim 1 wherein the housing is comprised of one or more of plastic or metal.

3. The lighting device of claim 1 wherein the housing is integrally formed as a portion of the gun grip.

4. The lighting device of claim 1 wherein the housing is formed at an angle of 0°-45° from a vertical axis.

5. The lighting device of claim 1 wherein the mirror is not connected to the laser module.

6. The lighting device of claim 1 wherein the position of the laser module can be adjusted thereby adjusting the direction of light emitted from the first end.

7. The lighting device of claim 6 wherein the position of the laser module is adjusted by set screws threadingly received in openings in the housing.

8. The lighting device of claim 6 wherein the position of the laser module can be adjusted in at least two cross-axial directions.

9. The lighting device of claim 1 wherein the position of the mirror can be adjusted to change the direction of light emitted from the first end of the laser module.

10. The lighting device of claim 9 wherein the power source is one or more batteries.

11. The lighting device of claim 1 wherein the power source is physically separated from and below the light source.

12. The lighting device of claim 11 that further includes a PCB in electrical communication with the switch and the power source.

13. The lighting device of claim 1 wherein the housing comprises a first section and a second section and the laser module and mirror are in the first section.

14. The lighting device of claim 1 wherein the housing comprises a first section and a second section and a cap is in the second section, the cap being removable to remove and insert batteries.

15. The lighting device of claim 13 wherein the switch is mounted on the first section.

16. The lighting device of claim 13 wherein one or more fastening devices connect the first section to the second section.

17. The lighting device of claim 16 wherein the one or more fastening devices is a single screw.

18. The lighting device of claim 15 wherein the gun has a handle frame and the first section of the housing is positioned on one side of the handle frame and the second section of the housing is positioned on the opposite side of the handle frame.

19. The lighting device of claim 1 wherein the switch is a momentary switch.

20. The lighting device of claim 1 wherein the housing containing the laser module has a lens through which light emitted from the first end of the laser module passes.

21. The lighting device of claim 1 wherein the housing is configured to be behind a trigger and a trigger guard of the gun.

22. The lighting device of claim 1 wherein the gun has a cylinder and the housing is configured to be behind the cylinder of the gun.

23. The lighting device of claim 22 wherein the housing is above the cylinder of the gun.

24. The lighting device of claim 1 wherein the switch is located in front of the housing.

25. The lighting device of claim 1 that requires a force of 5 lbs. or more to activate the switch.

26. A gun including the lighting device of claim 1.

* * * * *